US006550896B2

(12) United States Patent
Silverbrook

(10) Patent No.: US 6,550,896 B2
(45) Date of Patent: Apr. 22, 2003

(54) NOZZLE ARRANGEMENT FOR AN INK JET PRINTHEAD THAT INCLUDES A SHAPE MEMORY ACTUATOR

(75) Inventor: Kia Silverbrook, Balmain (AU)

(73) Assignee: Silverbrook Research Pty Ltd, Balmain (AU)

( * ) Notice: Subject to any disclaimer, the term of this patent is extended or adjusted under 35 U.S.C. 154(b) by 0 days.

(21) Appl. No.: 09/900,176

(22) Filed: Jul. 9, 2001

(65) Prior Publication Data

US 2001/0043254 A1 Nov. 22, 2001

Related U.S. Application Data

(63) Continuation-in-part of application No. 09/113,122, filed on Jul. 10, 1998.

(30) Foreign Application Priority Data

Jul. 15, 1997 (AU) ..... P08004

(51) Int. Cl.[7] ..... B41J 2/04; B41J 2/015; B41J 2/14

(52) U.S. Cl. ..... 347/54; 347/20; 347/47

(58) Field of Search ..... 347/20, 44, 47, 347/54, 68–72, 55; 29/890.1; 310/328–330

(56) References Cited

U.S. PATENT DOCUMENTS 5,812,159 A * 9/1998 Anagnostopoulos et al. .. 347/55
5,903,380 A 5/1999 Motamedi et al.
5,980,719 A * 11/1999 Cherukuri et al. ..... 347/55
5,982,521 A * 11/1999 Bessho et al. ..... 359/198

FOREIGN PATENT DOCUMENTS

EP 0416540 A2 * 3/1991 ..... 347/68
JP 359093356 A * 5/1984 ..... 347/85

* cited by examiner

*Primary Examiner*—Huan Tran
*Assistant Examiner*—An H. Do

(57) ABSTRACT

A nozzle arrangement for an ink jet printhead includes a substrate. Nozzle chamber walls are arranged on the substrate to define a nozzle chamber of the nozzle arrangement. An actuator is provided for ejecting ink from the nozzle chamber. The actuator includes an actuating member, a portion of the actuating member being in the form of a shape memory material which is capable of generating movement of the actuating member between pre-operative and post-operative positions when the shape memory material undergoes a structural change to or from a trained shape under predetermined conditions to eject ink from the nozzle chamber. The actuator includes a transformation mechanism that is operatively arranged with respect to the shape memory material to generate said predetermined conditions.

10 Claims, 4 Drawing Sheets

NOZZLE ARRANGEMENT FOR AN INK JET PRINTHEAD THAT INCLUDES A SHAPE MEMORY ACTUATOR

REFERENCES TO U.S. APPLICATIONS

This application is a continuation-in-part application of U.S. application Ser. No. 09/113,122, filed on Jul. 10, 1998, now allowed. The U.S. application Ser. No. 09/113,122 is hereby incorporated by reference.

FIELD OF THE INVENTION

This invention relates to ink jet printheads. More particularly, this invention relates to a nozzle arrangement for an ink jet printhead that includes a shape memory actuator.

BACKGROUND OF THE INVENTION

The Applicant has invented an ink jet printhead that is capable of generating text and images at a resolution of up to 1600 dpi.

In order to achieve this, the Applicant has made extensive use of micro electro-mechanical systems technology. In particular, the Applicant has developed integrated circuit fabrication techniques suitable for the manufacture of such printheads. The Applicant has filed a large number of patent applications in this field, many of which have now been allowed.

The printheads developed by the Applicant can include up to 84000 nozzle arrangements. Each nozzle arrangement has at least one moving component that serves to eject ink from a nozzle chamber. The components usually either act directly on the ink or act on a closure which serves to permit or inhibit the ejection of ink from the nozzle chamber.

The moving components within the printheads are microscopically dimensioned. This is necessary, given the large number of nozzle arrangements per printhead. The Applicant has spent a substantial amount of time and effort overcoming the difficulties associated with achieving effective movement of such components in order to eject ink.

The high density of nozzle arrangements precludes the use of heating the ink to an extent necessary to achieve the ejection of the ink, a technique which has been developed for scanning ink jet printheads. This form of ink ejection is possible with such ink jet printheads since the nozzle arrangements are positioned on a printhead that physically scans the print medium. Thus, the number of nozzle arrangements required is substantially less. Applicant has found that the heat build-up in a printhead incorporating up to 84000 nozzle arrangements would simply be too high for the printhead to operate efficiently, if at all.

It is also important to note that the high number of nozzle arrangements makes it essential that energy use is kept to a minimum. Applicant is aware of a number of prior art configurations which utilize piezoelectric expansion of metal to achieve buckling and subsequent drop ejection. Again, with the high number of nozzle arrangements used for the page width printhead of this invention, such configurations have excessive energy demands.

The Applicant has found that phase change characteristics of particular materials can be utilized efficiently in such ink jet printheads. Accordingly, the Applicant has applied this principle and has conceived this invention to address the problems associated with the prior art configurations mentioned above.

SUMMARY OF THE INVENTION

According to a first aspect of the invention, there is provided a nozzle arrangement for an ink jet printhead, the nozzle arrangement comprising a substrate;

nozzle chamber walls arranged on the substrate to define a nozzle chamber of the nozzle arrangement; and an actuator for ejecting ink from the nozzle chamber, the actuator comprising:

at least one actuating member, at least a portion of the, or each, actuating member being in the form of a shape memory material which is capable of generating movement of the, or each, actuating member between pre-operative and post-operative positions when the shape memory material undergoes a structural change to or from a trained shape under predetermined conditions to eject ink from the nozzle chamber; and a transformation mechanism that is operatively arranged with respect to the shape memory material to generate said predetermined conditions.

According to a second aspect of the invention, there is provided an ink jet printhead that comprises:

a substrate; and at least one nozzle arrangement positioned on the substrate, the, or each, nozzle arrangement comprising:

nozzle chamber walls arranged on the substrate to define a nozzle chamber of the nozzle arrangement; and an actuator for ejecting ink from the nozzle chamber, the actuator comprising:

at least one actuating member, at least a portion of, the, or each, actuating member being in the form of a shape memory material which is capable of generating movement of the, or each, actuating member between pre-operative and post-operative positions when the shape memory material undergoes a structural change to or from a trained shape under predetermined conditions to eject ink from the nozzle chamber; and a transformation mechanism that is operatively arranged with respect to the shape memory material to generate said predetermined conditions.

The invention is now described, by way of examples, with reference to the accompanying drawings. The specific nature of the following description should not be construed as limiting in any way the broad scope of this summary.

DETAILED DESCRIPTION OF THE DRAWINGS

Figure 1:
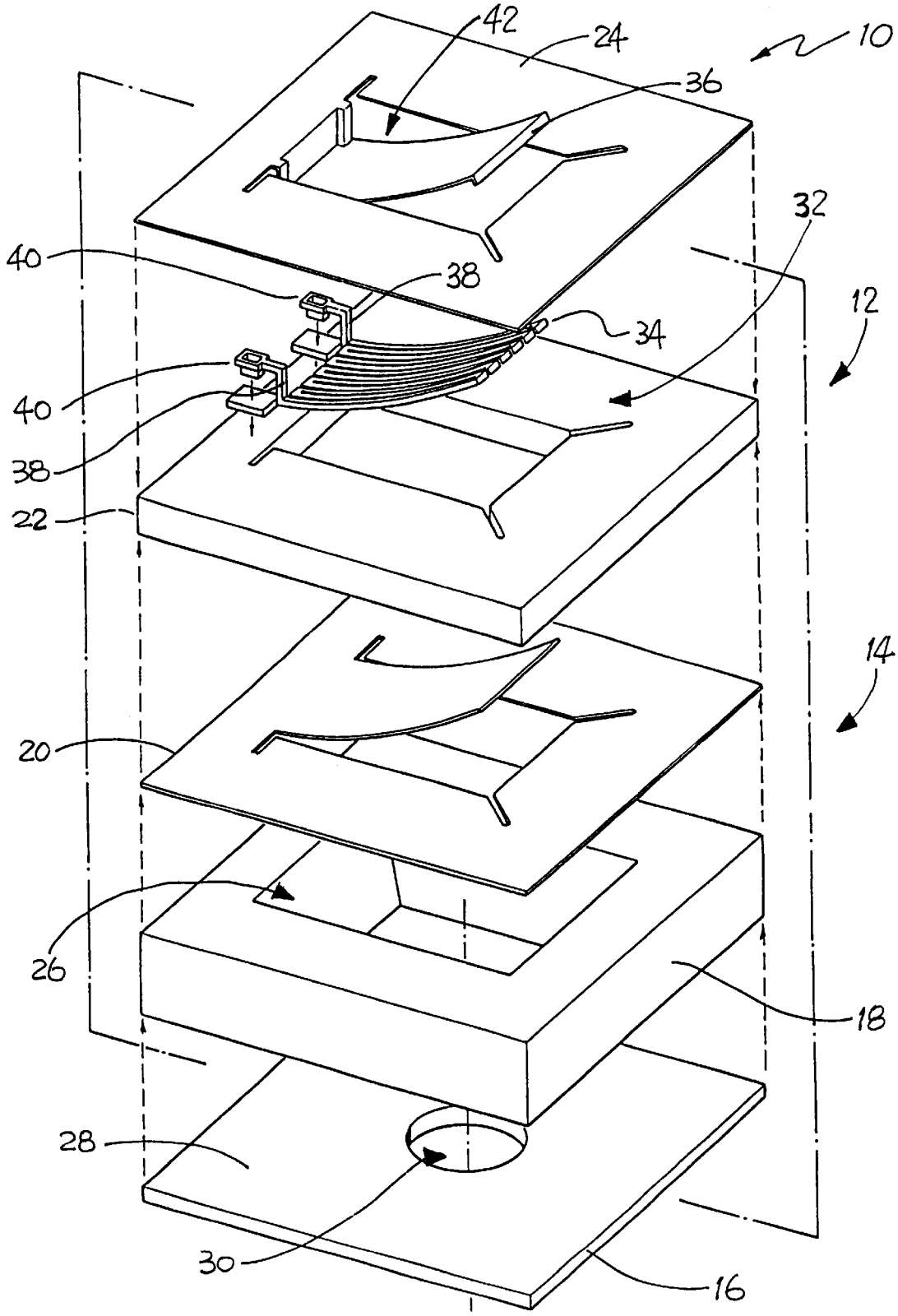
FIG. 1 shows a three dimensional, exploded view of a nozzle arrangement, in accordance with the invention, for an ink jet printhead.
Figure 2:
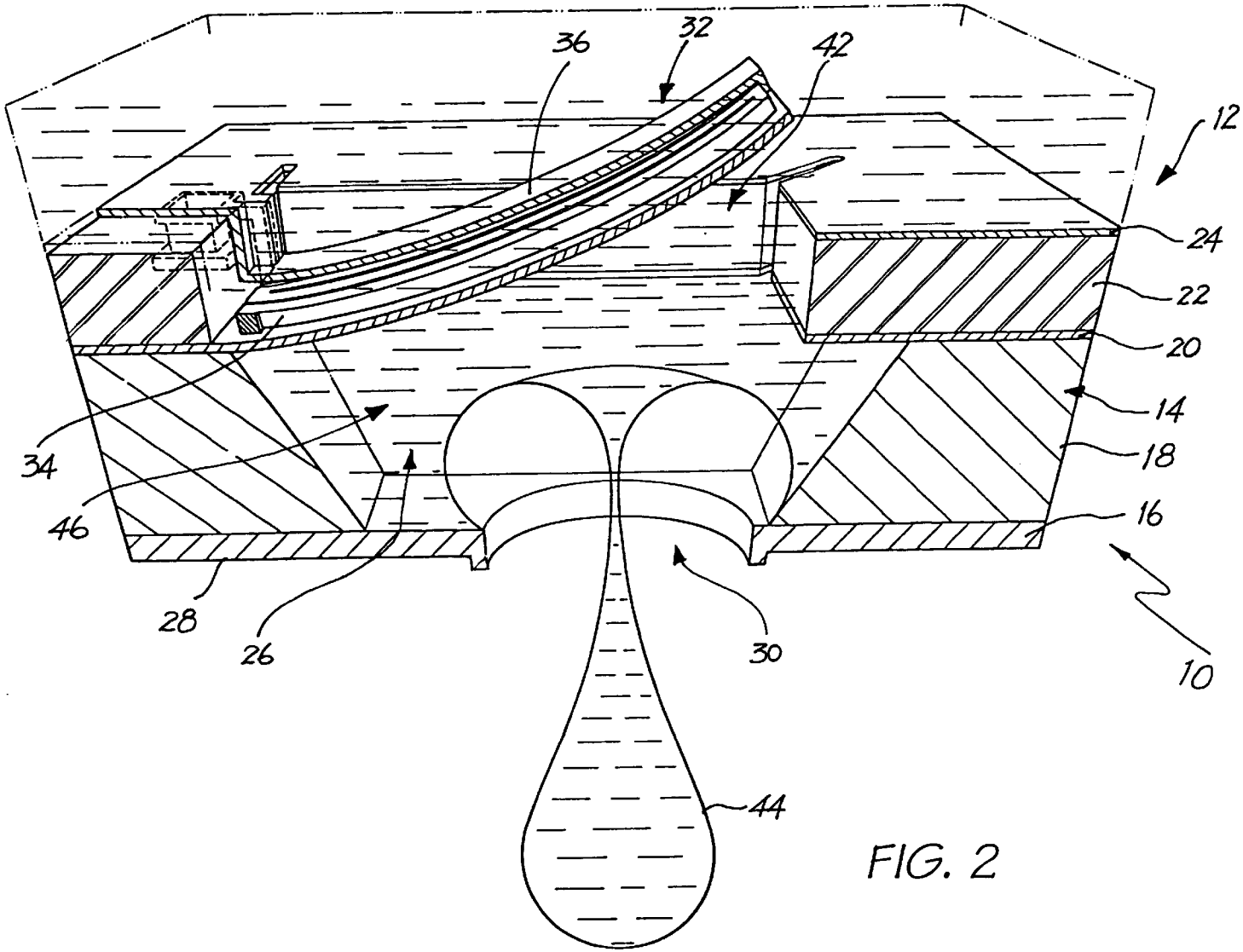
FIG. 2 shows a sectioned three-dimensional view of the nozzle arrangement of FIG. 1 in a pre-operative condition.
Figure 3:
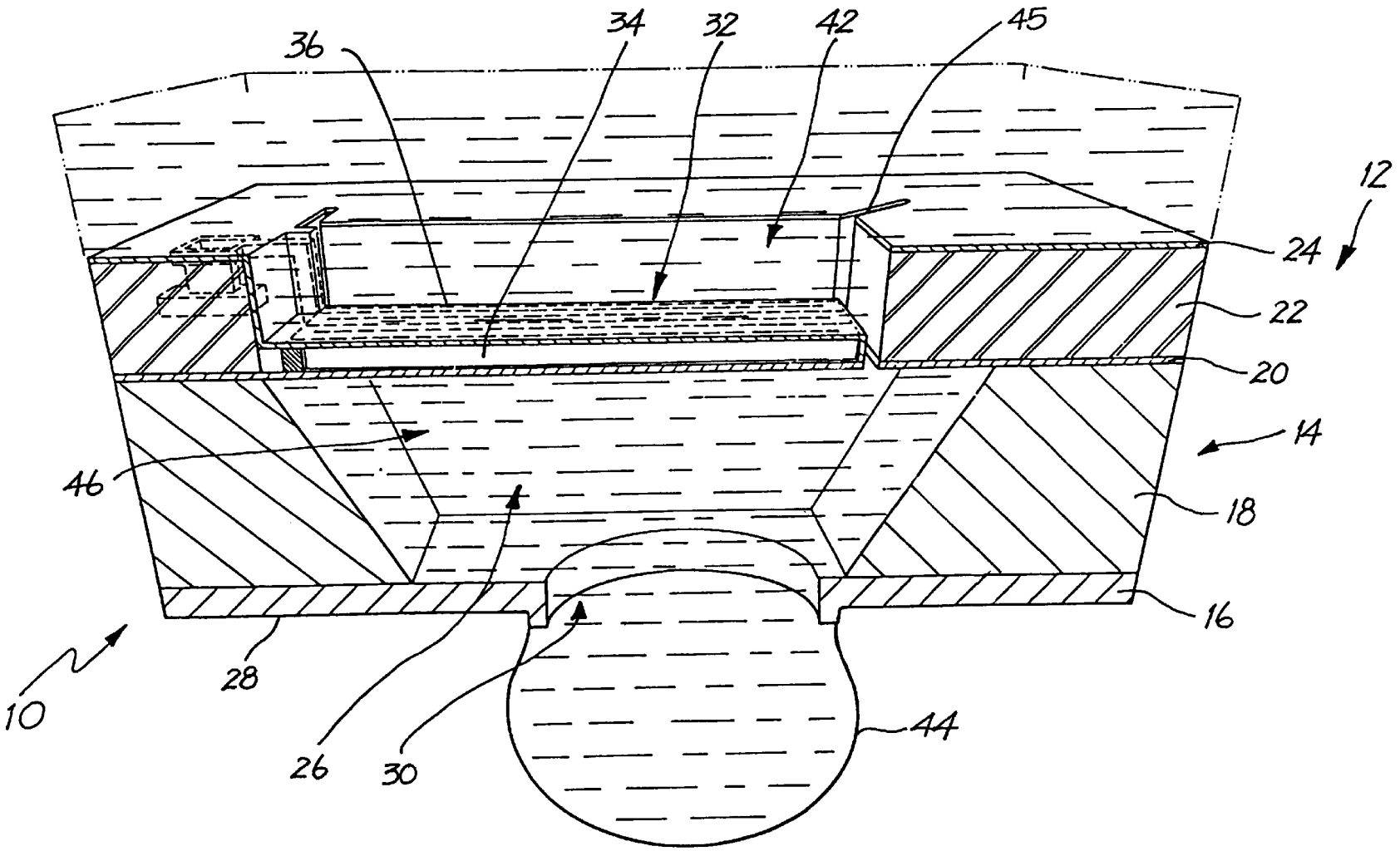
FIG. 3 shows a sectioned three-dimensional view of the nozzle arrangement of FIG. 1 in a post-operative condition.

In FIGS. 1 to 3, reference numeral 10 generally indicates a first embodiment of a nozzle arrangement, in accordance with the invention, for an ink jet printhead.

The nozzle arrangement 10 is one of a plurality of such nozzle arrangements forming part of an ink jet printhead, indicated at 12. As set out in the preamble, the ink jet printhead can include up to 84000 such nozzle arrangements. The accompanying drawings illustrate one of the nozzle arrangements for the sake of convenience. It will be appreciated that the printhead comprises a replication of the part 12 shown in the drawings.

The nozzle arrangement 10 includes a substrate 14. The substrate 14 includes a wafer substrate 18. An etch stop layer 16 is positioned on the wafer substrate 18 as a result of a deposition process. A silicon dioxide layer 20 is positioned on the wafer substrate 18. A drive circuitry layer 22 is positioned on the silicon dioxide layer 20 and a silicon nitride layer 24 is positioned on the drive circuitry layer 22.

The wafer substrate 18 is etched to define a nozzle chamber 26. The etch stop layer 16 thus defines a roof wall 28, the etch stop layer 16 itself being etched to define an ink ejection port 30.

The nozzle arrangement 10 includes an actuator 32 for ejecting ink from the nozzle chamber 26 out of the ink ejection port 30. The actuator 32 includes a heater element 34. The heater element 34 is of a shape memory alloy. In this particular example, the heater element 34 is a nickel titanium alloy commonly known as Nitinol. It will readily be appreciated that any other suitable shape memory alloy can be used, provided it has suitable characteristics.

Those of ordinary skill in the field of shape memory alloys will appreciate that Nitinol can be used to generate movement when it is transformed from the martensitic phase to the austenitic phase through annealing by the application of a suitable temperature. In particular, shape memory alloys have the ability to return to a predetermined shape when heated. The temperature at which the material returns to the predetermined shape is known as its transformation temperature. When a shape memory alloy is below its transformation temperature, it generally has very low yield strength and can be deformed quite easily into any new shape, which it will retain. In this case, when the Nitinol is in its martensitic phase, it can be deformed into a pre-operative shape as shown in FIGS. 1 and 2.

However, when the Nitinol is heated above its transformation temperature, it undergoes a change in crystal structure that causes it to return to its original shape. This change in crystal structure occurs when the martensitic phase enters the austenitic phase. As is known, if the Nitinol encounters any resistance during this transformation, it can generate extremely large forces. It follows that this phenomenon provides a unique mechanism for remote actuation.

Nitinol is capable of up to 5 per cent strain recovery and up to 50000 psi restoration stress with what is regarded by those skilled in the art as a high number of stress cycles. Furthermore, Nitinol also has suitable resistance properties that enable it to be actuated electrically by resistive or joule heating. It follows that when an electric current is passed through a Nitinol wire, it can generate enough heat to cause the phase transformation.

In this case, the heater element 34 is provided with a generally planar configuration, as shown in FIG. 3, when the Nitinol is above the transformation temperature. When the Nitinol is below the transformation temperature, the heater element 34 is deformed into the shape shown in FIGS. 1 and 2.

This is achieved by depositing the silicon nitride layer 24 onto the planar heater element 34 under tension. The resulting contraction of that portion 36 of the silicon nitride layer 36 positioned on the heater element 34 results in the heater element 34 bending, while in its martensitic phase, into the shape shown in FIGS. 1 and 2.

The heater element 34 has a suitably thin cross sectional area and has a serpentine configuration as can be seen in FIG. 1. Ends 38 of the heater element 34 are connected to drive circuitry within the drive circuitry layer 22 with vias 40. As can be seen in the, drawings, the heater element 34 is positioned between the silicon dioxide layer 20 and the silicon nitride layer 24 to define a laminated structure. Further, the actuator 32 is positioned to span an inlet 42 of the nozzle chamber 26. Also, as can clearly be seen in the drawings, the heater element 34 is bent away from the ink ejection port 30 when in its pre-operative condition as shown in FIGS. 1 and 2.

When the heater element 34 is heated by means of an electric current applied by the drive circuitry through the vias 40, the heater element 34 heats to a temperature above the transformation temperature, thereby moving into its austenitic phase and into the position shown in FIG. 3. This is carried out against a tension that is developed in the portion 36 of the silicon nitride layer 24. This movement results in the creation of a drop 44 of ink 46, as shown in FIG. 3. When the heater element 34 cools to a point below the transformation temperature, the tension in the portion 36 of the silicon nitride layer 24 results in the actuator 32 moving back into the position shown in FIG. 2 resulting in a necking of the ink 46 and separation of the drop 44.

It will be appreciated that, by providing a suitable control system (not shown) connected to the drive circuitry layer 22, selective ejection of ink 46 from the nozzle arrangement 10 can be achieved.

Figure 4:
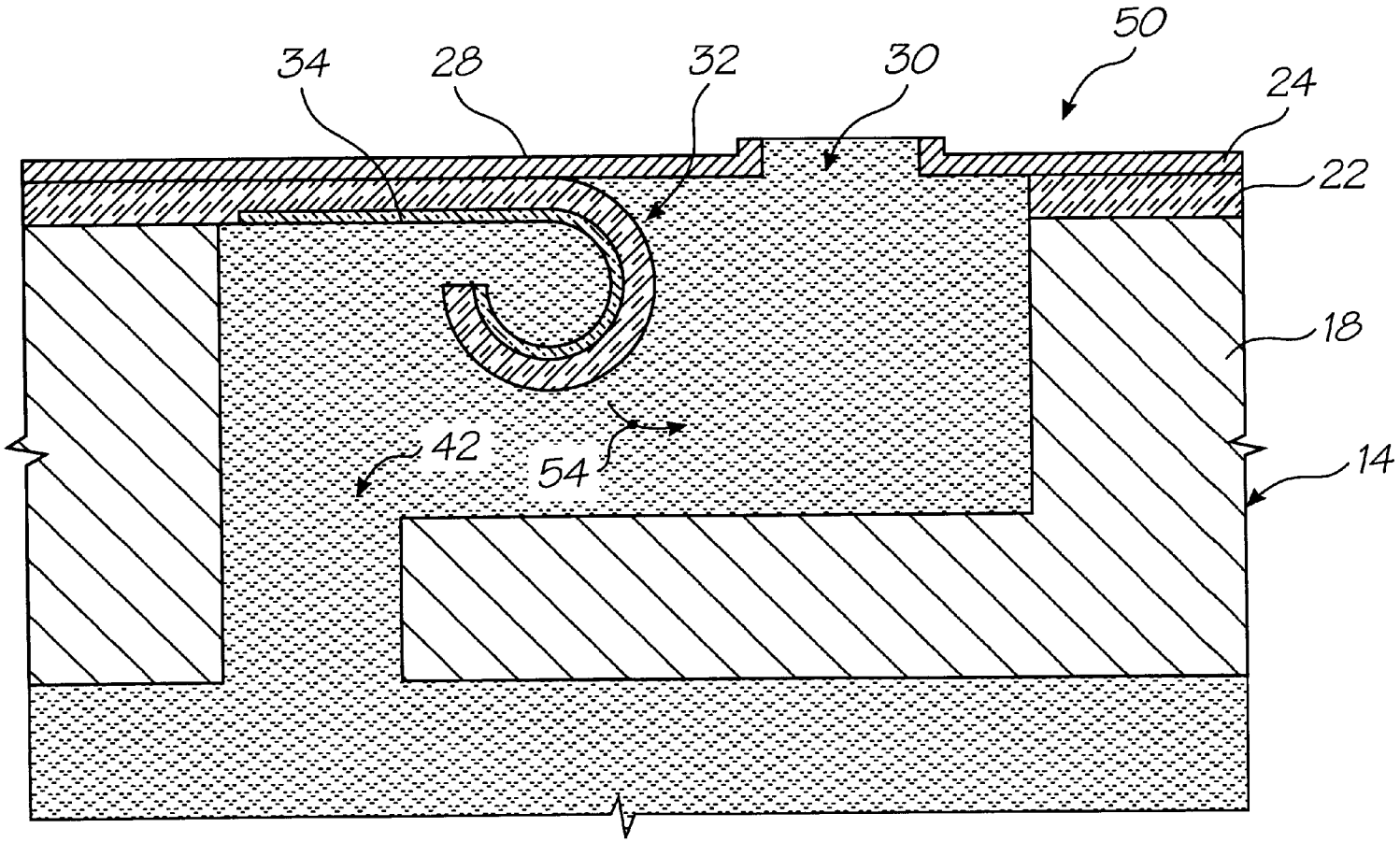
FIG. 4 shows a schematic view of a further embodiment of a nozzle arrangement, in accordance with the invention, for an ink jet printhead, in a pre-operative condition.

In FIG. 4, reference numeral 50 generally indicates a second embodiment of a nozzle arrangement, in accordance with the invention, for an ink jet printhead. With reference to FIGS. 1 to 3, like reference numerals refer to like parts, unless otherwise specified.

The embodiment 50 has been incorporated to indicate that the actuator 32 can take a number of different forms. In this particular embodiment, the actuator 32 is coiled into a volume 52 of the nozzle chamber 26. This coil is applied when the heater element 34 is in its martensitic phase. Furthermore, when above the transformation temperature, the heater element is provided with a partially uncoiled configuration. It follows that activation of the heater element 34 results in a partial uncoiling of the actuator 32 in the direction of an arrow 54. This causes the ejection of a drop of ink from the ink ejection port 30. The mechanism of this operation is substantially identical to that of the nozzle arrangement 10.

Thus, when the heater element 34 cools, the actuator 32 returns to the coiled condition shown in FIG. 4.

Applicant believes that the use of a shape memory alloy to achieve the ejection of a drop of ink is a useful and convenient way of obtaining movement of a microscopic component of the nozzle arrangement of the invention.

What is claimed is:

1. A nozzle arrangement for an ink jet printhead, the nozzle arrangement comprising a wafer substrate;

nozzle chamber walls arranged on the wafer substrate to define a nozzle chamber of the nozzle arrangement and an ink ejection port in fluid communication with the nozzle chamber, the nozzle chamber walls being the product of at least an etching process carried out on the substrate; and an actuator for ejecting ink from the nozzle chamber, the actuator comprising:

at least one actuating member that is displaceable between pre-operative and post-operative positions with respect to the nozzle chamber walls to eject ink from the ink ejection port, at least a portion of the, or each, actuating member being in the form of a shape memory material which is capable of generating said displacement of the, or each, actuating member between pre-operative and post-operative positions when the shape memory material undergoes a structural change to or from a trained shape under predetermined conditions; and a transformation mechanism that is operatively arranged with respect to the shape memory material to generate said predetermined conditions.

2. A nozzle arrangement as claimed in claim 1, which is the result of an integrated circuit fabrication technique so that the nozzle arrangement includes a wafer substrate and a drive circuitry layer.

3. A nozzle arrangement as claimed in claim 2, which defines a micro electro-mechanical system.

4. A nozzle arrangement as claimed in claim 3, in which the transformation mechanism is in the form of a heat-generating mechanism and the shape memory material is capable of being transformed into its trained shape on the application of heat by the heat-generating mechanism, to facilitate the generation of movement between the pre-operative and post-operative positions.

5. A nozzle arrangement as claimed in claim 4, in which said material is in the form of a shape memory alloy, the actuating member defining its pre-operative condition when said shape memory alloy is below its transformation temperature and the actuating member defining its operative condition when the shape memory alloy is above its transformation temperature.

6. A nozzle arrangement as claimed in claim 5, in which the shape memory alloy is selected so that the actuating member defines a martensitic device so that, when the actuating member is in its pre-operative condition, the shape memory alloy is in a martensitic phase and when the actuating member is in an operative condition, the shape memory alloy is in an austenitic phase.

7. A nozzle arrangement as claimed in claim 6, in which the shape memory alloy is a nickel titanium alloy.

8. A nozzle arrangement as claimed in claim 5, in which the actuating member is layered with the shape memory alloy comprising a layer of the actuating member and a further layer of the actuating member comprising a tensioned layer which is configured so that, when the tensioned layer is positioned on the layer of shape memory alloy, the layer of the shape memory alloy is deformed together with the tensioned layer into the pre-operative condition.

9. A nozzle arrangement as claimed in claim 8, in which the layer of the shape memory alloy defines a heating element that is capable of being resistively heated when a current is passed through the heating element, the layer of the shape memory alloy being electrically connected to drive circuitry within the drive circuitry layer.

10. An ink jet printhead that comprises:

a wafer substrate; and at least one nozzle arrangement positioned on the wafer substrate, the, or each, nozzle arrangement comprising:

nozzle chamber walls arranged on the wafer substrate to define a nozzle chamber of the nozzle arrangement and an ink ejection port in fluid communication with the nozzle chamber, the nozzle chamber walls being the product of a deposition and etching process carried out on the wafer substrate; and an actuator for ejecting ink from the nozzle chamber, the actuator comprising:

at least one actuating member that is displaceable between pre-operative and post-operative positions with respect to the nozzle chamber walls to eject ink from the ink ejection port, at least a portion of, the, or each, actuating member being in the form of a shape memory material which is capable of generating said displacement of the, or each, actuating member when the shape memory material undergoes a structural change to or from a trained shape under predetermined conditions; and a transformation mechanism that is operatively arranged with respect to the shape memory material to generate said predetermined conditions.

* * * * *